US008453884B2

(12) United States Patent
Fang

(10) Patent No.: US 8,453,884 B2
(45) Date of Patent: Jun. 4, 2013

(54) DIAPHRAGM PUMP ACTUATED LIQUID DISPENSING APPARATUS HAVING DOME SHAPED DEFORMABLE MEMBRANE

(76) Inventor: Kuo-Chung Fang, Tainan (TW)

( * ) Notice: Subject to any disclaimer, the term of this patent is extended or adjusted under 35 U.S.C. 154(b) by 253 days.

(21) Appl. No.: 12/975,108

(22) Filed: Dec. 21, 2010

(65) Prior Publication Data

US 2012/0000942 A1 Jan. 5, 2012

(30) Foreign Application Priority Data

Jul. 1, 2010 (TW) ..... 99121656 A

(51) Int. Cl.
*B65D 37/00* (2006.01)

(52) U.S. Cl.
USPC ..... 222/209; 222/153.13; 222/256; 222/405; 222/533; 222/538

(58) Field of Classification Search
USPC ..... 222/153.13, 209, 214, 256, 259, 222/319, 380, 401, 405, 491, 494, 495, 533, 222/534, 536, 538, 539
See application file for complete search history.

(56) References Cited

U.S. PATENT DOCUMENTS 496,843 A * 5/1893 Arnott ..... 222/209
862,867 A * 8/1907 Eggleston ..... 417/390
2,098,160 A * 11/1937 Perritt ..... 222/209
2,105,370 A * 1/1938 Paul ..... 222/209
2,443,146 A * 6/1948 Pyles ..... 222/318
3,777,941 A * 12/1973 Riddle ..... 222/207
3,877,614 A * 4/1975 Murphy ..... 222/209
4,120,427 A * 10/1978 McRoskey et al. ..... 222/632
4,420,098 A * 12/1983 Bennett ..... 222/190
4,880,161 A * 11/1989 Wright ..... 239/330
5,957,340 A * 9/1999 Sawicki ..... 222/209
2006/0208007 A1 * 9/2006 Martin et al. ..... 222/494
2009/0001102 A1 * 1/2009 Fang ..... 222/260

* cited by examiner

*Primary Examiner* — Kevin P Shaver
*Assistant Examiner* — Patrick M Buechner
(74) *Attorney, Agent, or Firm* — Schwabe, Williamson & Wyatt, P.C.

(57) ABSTRACT

A liquid dispensing apparatus includes a receptacle defining a chamber for containing a liquid material and having a top opening. A press mechanism includes a sealing valve disposed movably in the chamber and covering the top opening, and a press seat disposed above the sealing valve to move the sealing valve in the chamber. The sealing valve has a deformable membrane facing an interior of the chamber and adapted to press the liquid material. The press seat has a base plate, and a press rod projecting downwardly from the base plate and having a lower end connected to the deformable membrane. The deformable membrane deforms when pressed by the press rod, and produces a suction force when returning to an original shape.

8 Claims, 8 Drawing Sheets

DIAPHRAGM PUMP ACTUATED LIQUID DISPENSING APPARATUS HAVING DOME SHAPED DEFORMABLE MEMBRANE

CROSS-REFERENCE TO RELATED APPLICATION

This application claims priority of Taiwanese Application No. 099121656, filed on Jul. 1, 2010.

BACKGROUND OF THE INVENTION

1. Field of the Invention

The invention relates to a liquid dispensing apparatus, and more particularly to a liquid dispensing apparatus that is suitable for containing a liquid or paste material and that uses a press method to obtain the liquid or paste material.

2. Description of the Related Art

Referring to FIG. 1, a conventional liquid dispensing apparatus 1 includes a receptacle 11 defining a chamber 111 and having a dispensing channel 112, a press mechanism 12 disposed within the chamber 111, a dispensing mechanism 13 provided on the dispensing channel 112, and a cover 14 for pressing downward the press mechanism 12. The receptacle 11 further has a through hole 113 intercommunicating fluidly the chamber 111 and the dispensing channel 112. The press mechanism 12 includes a sealing valve 121 that is movable upward and downward within the chamber 111 and that covers a top opening of the receptacle 11, a piston seat 123 disposed in a piston chamber 122 of the sealing valve 121, a press plate 124 disposed above the sealing valve 121, a link rod 125 connected to and movable along with the press plate 124 and the piston seat 123, and a spring component 127 having two opposite ends abutting respectively against the press plate 124 and a bottom wall 126 of the sealing valve 121. The dispensing mechanism 13 includes a dispensing seat 132 disposed above the dispensing channel 112 and having a liquid outlet 131 communicable fluidly with the dispensing channel 112, and a valve rod 133 disposed movably on the dispensing seat 132 to close or open the liquid outlet 131.

To use the conventional liquid dispensing apparatus 1, the cover 14 is pressed to push the press mechanism 12 downward. When the press mechanism 12 moves downward, the piston seat 123 and the sealing valve 121 push the liquid material in the chamber 111, causing it to flow through the through hole 113 and the dispensing channel 112. The liquid material then pushes the valve rod 133 partially out of the dispensing seat 132 to open the liquid outlet 131, thereby moving the dispensing mechanism 13 from a closed position to a dispensing position. When pressure on the cover 14 is released, the spring component 127 biases the press plate 124 and the piston seat 123 upward. When the piston seat 123 moves upward, it produces a suction force to draw the liquid material in the dispensing channel 112 back into the chamber 111. The suction force results in movement of the valve rod 133 back into the dispensing seat 132 to close the liquid outlet 131, there by shifting the dispensing mechanism 13 from the dispensing position to the closed position.

Although a suction force may be produced in the chamber 111 to restore the dispensing mechanism 13 to the closed position, the configuration of the press mechanism 12 is complicated, and may be troublesome to assemble.

SUMMARY OF THE INVENTION

Therefore, the object of the present invention is to provide a liquid dispensing apparatus that has a simple structure which is easy to assemble.

According to this invention, a liquid dispensing apparatus comprises a receptacle and a press mechanism. The receptacle defines a chamber for containing a liquid material, and has a top opening. The press mechanism includes a sealing valve disposed movably in the chamber and covering the top opening, and a press seat disposed above the sealing valve to move the sealing valve in the chamber. The sealing valve has a deformable membrane facing an interior of the chamber and adapted to press the liquid material. The press seat has a base plate, and a press rod projecting downwardly from the base plate and having a lower end connected to the deformable membrane. The deformable membrane deforms when pressed by the press rod, and produces a suction force when returning to an original shape.

Through the provision of the deformable membrane on the sealing valve, and by using the press rod of the press seat to control deformation and restoration of the deformable membrane, not only can the liquid material be drawn back into the chamber by the deformable membrane, but the aforesaid structure is also simple and easy to assemble.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
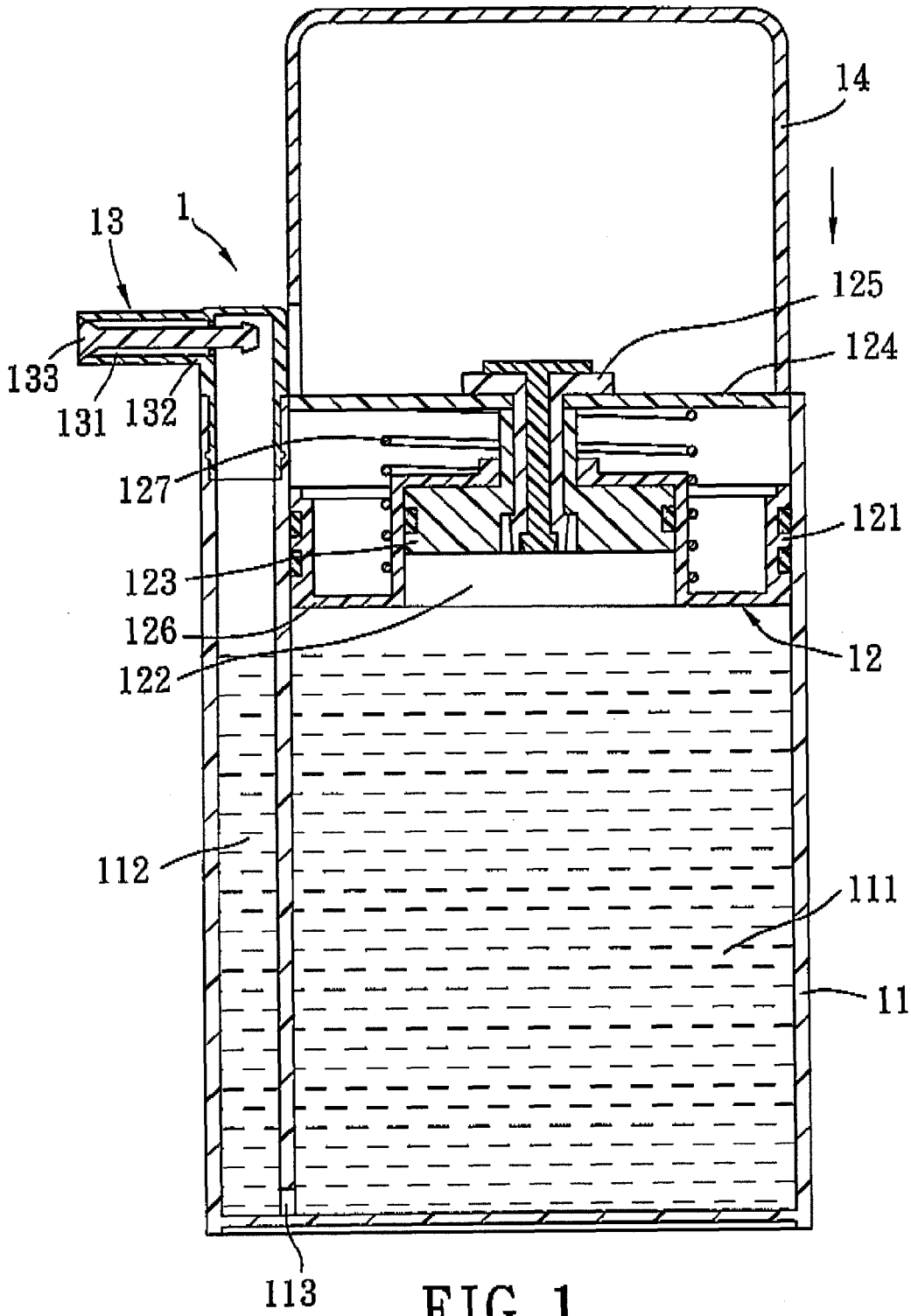
FIG. 1 PRIOR ART
FIG. 1 is a sectional view of a conventional liquid dispensing apparatus.
Figure 2:
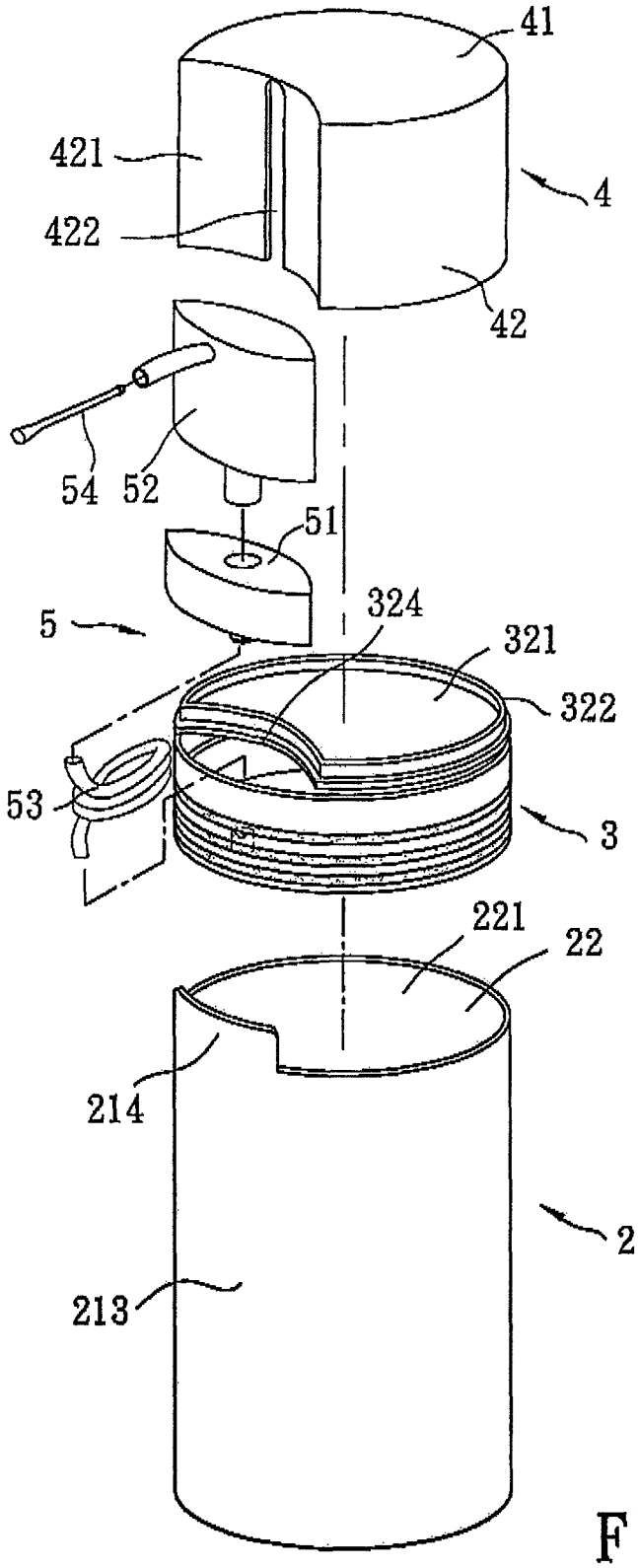
FIG. 2 is an exploded perspective view of a liquid dispensing apparatus according to the first preferred embodiment of the present invention.
Figure 3:
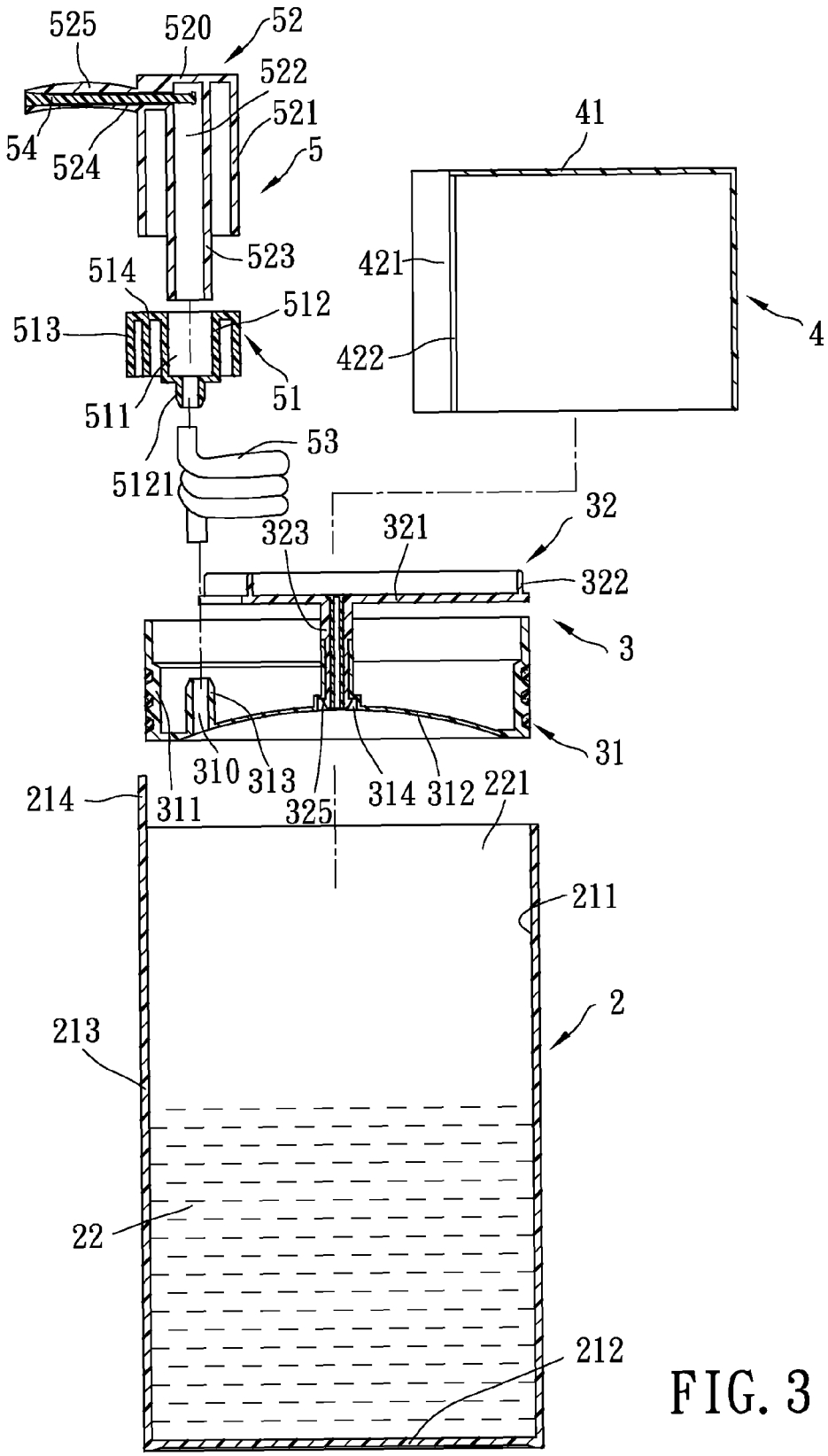
FIG. 3 is an exploded sectional view of the first preferred embodiment.

Before the present invention is described in greater detail, it should be noted that like elements are denoted by the same reference numerals throughout the disclosure.

Referring to FIGS. 2 to 6, a liquid dispensing apparatus according to the first preferred embodiment of the present invention is shown to comprise a receptacle 2, a press mechanism 3, a cover 4, and a dispensing mechanism 5.

The receptacle 2 includes a bottom wall 212, a surrounding wall 213 extending upwardly from an outer periphery of the bottom wall 212, and an insert portion 214 projecting upward from a top end of the surrounding wall 213. The bottom and surrounding walls 212, 213 cooperatively define a chamber 22 for containing a liquid material. The chamber 22 has a top opening 221.

The press mechanism 3 includes a sealing valve 31 disposed movably in the chamber 22 and covering the top opening 221, and a press seat 32 disposed above the sealing valve 31. The sealing valve 31 has a deformable membrane 312 facing an interior of the chamber 22 and adapted to press the liquid material, a peripheral wall 311 extending upwardly from an outer periphery of the deformable membrane 312 and abutting against an inner wall face 211 of the surrounding wall 213, and a connecting tube 313 projecting upwardly from the deformable membrane 312 in proximity to the insert portion 214 and defining a first channel 310. The deformable membrane 312 has a dome shape, is convex, and protrudes upward. The deformable membrane 312 has a maximum height (H1) (see FIG. 4) measured from a plane of the outer periphery. A retaining hole 314 is provided in a topmost part of the deformable membrane 312.

The press seat 32 has a base plate 321, a looped wall 322 extending upward from the base plate 321 in proximity to an outer periphery of the base plate 321, and a press rod 323 projecting downward from a central portion of the base plate 321. The base plate 321 has a cutout 324 proximate to the insert portion 214. The press rod 323 has a lower end 325 connected to the retaining hole 314 and abutting against the topmost part of the deformable membrane 312. A spacing (H2) (see FIG. 4) between a top end 315 of the peripheral wall 311 of the sealing valve 31 and a bottom face 326 of the base plate 321 is smaller than the maximum height (H1) of the deformable membrane 312.

The cover 4 is used to press downward the press mechanism 3, and includes a top wall 41 having a shape similar to that of the base plate 321, and a surrounding wall 42 extending downward from an outer periphery of the top wall 41 and sleeved fittingly around the looped wall 322. The surrounding wall 42 has a concave portion 421 facing the insert portion 214 and having an axially extending slot 422 opening downward.

The dispensing mechanism 5 is mounted to the receptacle 2, and is movable between a dispensing position and a closed position. The dispensing mechanism 5 includes a positioning seat 51, and a dispensing seat 52 mounted on the positioning seat 51. The positioning seat 51 includes a tubular wall 512 having a sleeve 5121 projecting downward therefrom and a connecting hole 511 extending along the length thereof, a positioning wall 513 disposed externally of and spaced apart from the tubular wall 512 and engaged to the insert portion 214, and a top wall 514 interconnecting the tubular wall 512 and the positioning wall 513. The dispensing seat 52 includes a surrounding wall 521 mounted on and supported by the top wall 514, a tubular wall 523 that is disposed within and spaced apart from the surrounding wall 521, that has a lower end inserted fittingly into the connecting hole 511, and that defines a second channel 522, a top wall 520 interconnecting the surrounding wall 521 and an upper end of the tubular wall 523, and an outlet tube 525 projecting horizontally from one side of the surrounding wall 521, defining a liquid outlet 524 communicating fluidly with the second channel 522, and being extendable through the slot 422. A spiral connecting hose 53 has two opposite ends sleeved fittingly and respectively on the sleeve 5121 and the connecting tube 313 to fluidly connect the first and second channels 310, 522. A valve rod 54 is disposed movably within the outlet tube 525 to close or open the liquid outlet 524, and extends through the tubular wall 523.

Figure 4:
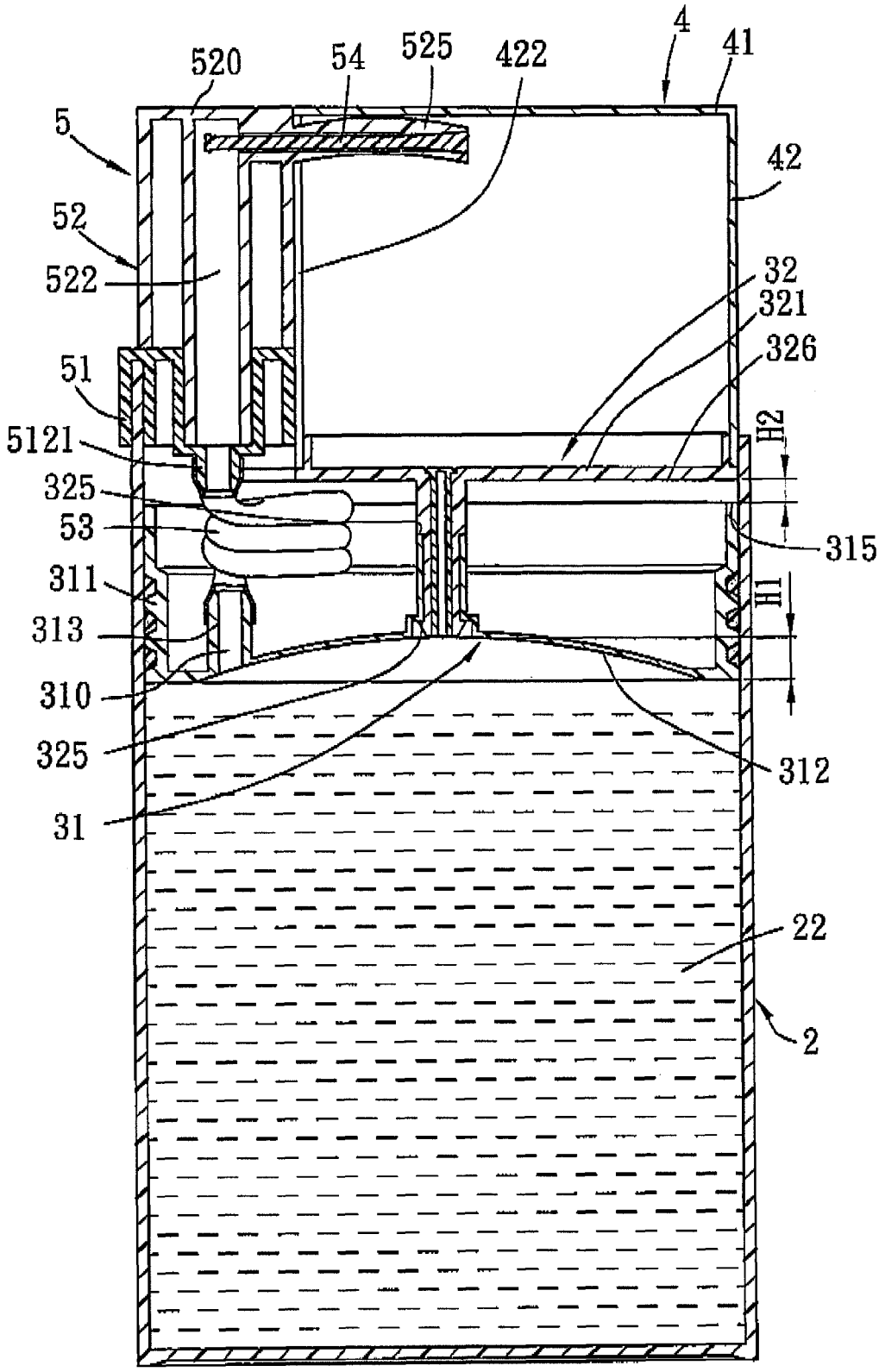
FIG. 4 is a sectional view of the first preferred embodiment in an assembled state.

With reference to FIG. 4, when the liquid dispensing apparatus of the present invention is at an unused or stored position, the outlet tube 525 is brought to extend through the slot 422 to be disposed inside the cover 4. Through this configuration, a packing volume of the present invention can be minimized. Further, through the presence of the outlet tube 525, the cover 4 can be prevented from being accidentally pressed downward to dispense the liquid.

Figure 5:
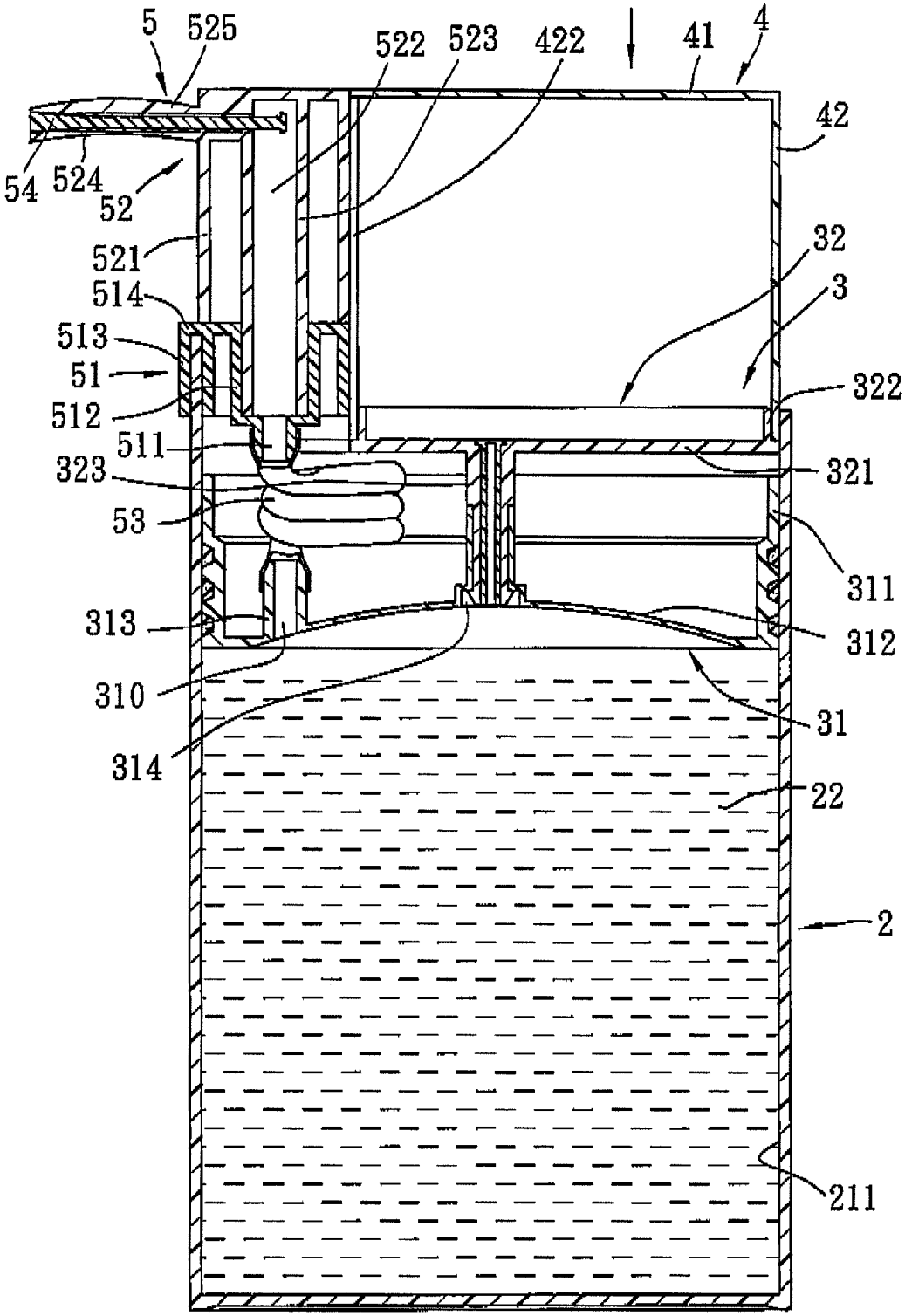
FIG. 5 is a sectional, view of the first preferred embodiment at a use position.
Figure 6:
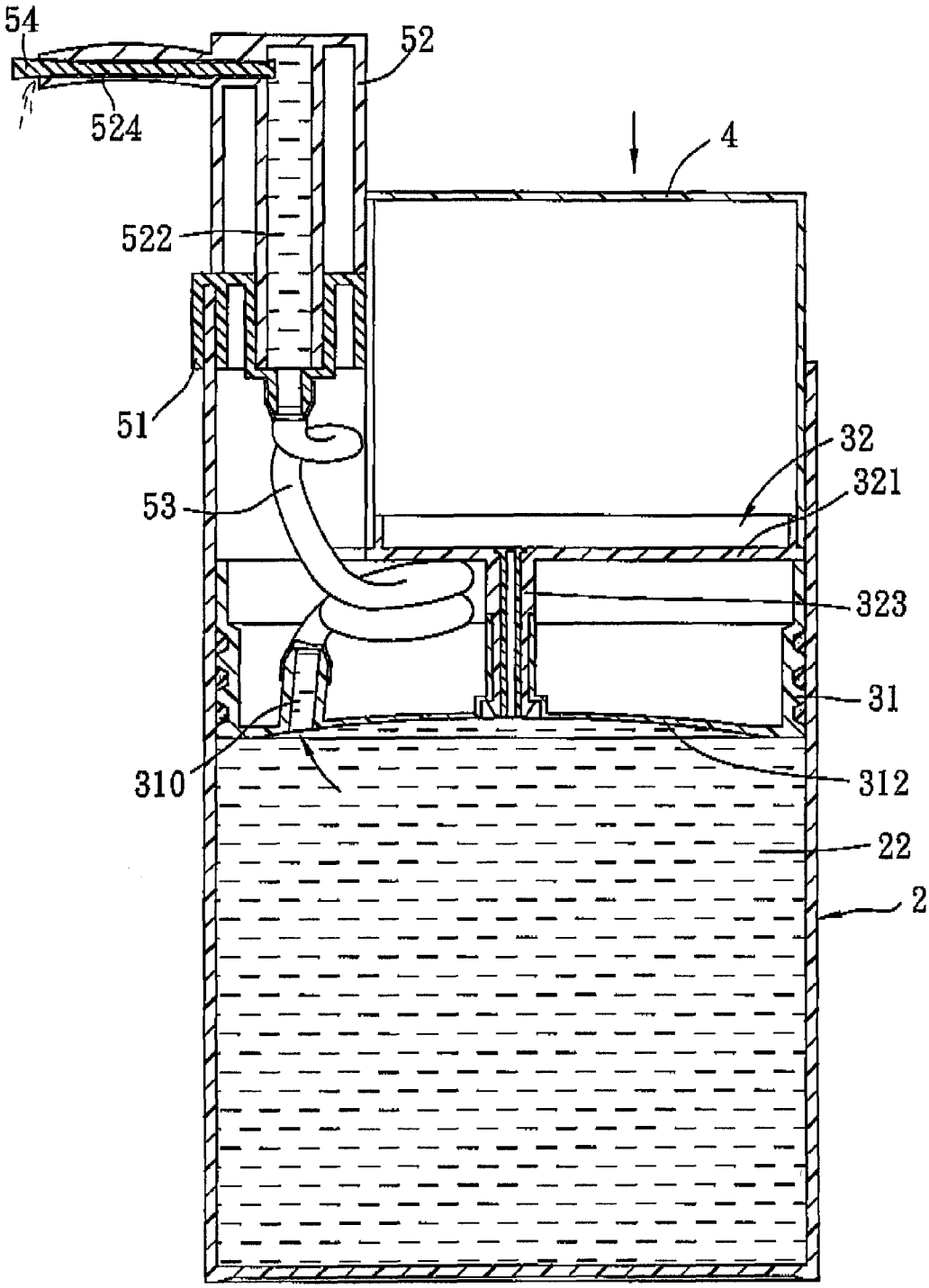
FIG. 6 is a sectional view of the first preferred embodiment at a dispensing position.

With reference to FIGS. 5 and 6, to use the liquid dispensing apparatus of the present invention, the cover 4 is first removed, and the outlet tube 525 is rotated relative to the positioning seat 51 to be disposed outward of and opposite to the cover 4. When the cover 4 is pressed downward, it pushes the press seat 32 to also move downward. As the press seat 32 moves downward, the press rod 323 presses and deforms the deformable membrane 312. The downward force moves the entire press mechanism 3 downward. When the deformable membrane 312 moves downward to a deformed position shown in FIG. 6 at this time, the liquid material is pressed to flow from the first channel 310 through the connecting hose 53 and the second channel 522, and pushes the valve rod 54 to move of the outlet tube 525 to open the liquid outlet 524, thereby moving the dispensing mechanism 5 from the closed position shown in FIG. 5 to the dispensing position shown in FIG. 6.

When pressure on the cover 4 is released, the press mechanism 3 will stop at a predetermined position, and the deformable membrane 312 will return to its original position through its restoring force and produce a suction force to draw the liquid material in the dispensing mechanism 5 back to the chamber 22. That is, by pressing down the cover 4, the liquid outlet 524 can be opened or closed automatically. Hence, the simple structure of liquid dispensing apparatus of this embodiment is not only easy to use, but is also easy to assemble.

Figure 7:
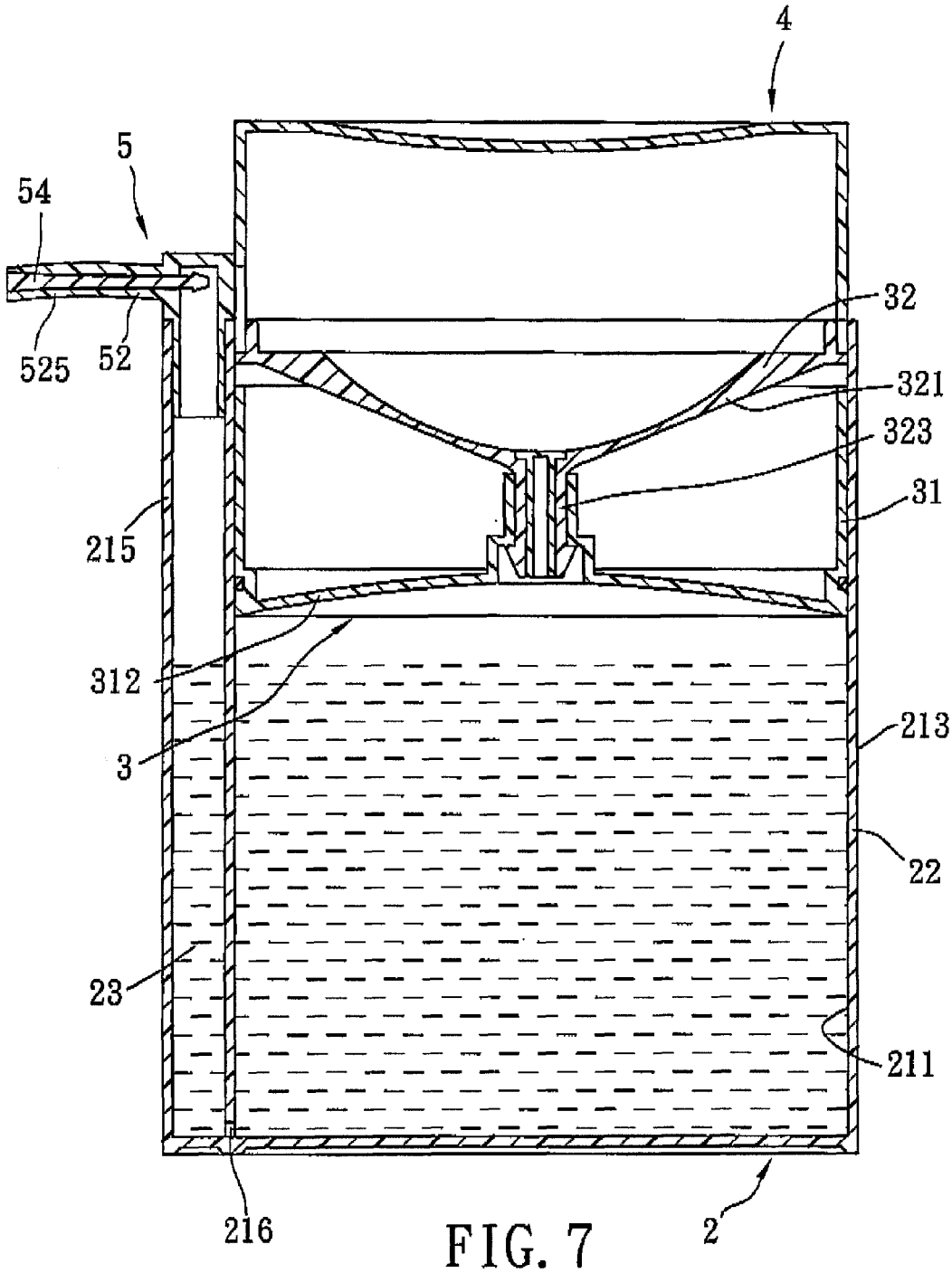
FIG. 7 is a sectional view of a liquid dispensing apparatus according to the second preferred embodiment of the present invention.

Referring to FIG. 7, a liquid dispensing apparatus according to the second preferred embodiment of the present invention is shown to be similar to the first preferred embodiment. However, in this embodiment, the surrounding wall 213 of the receptacle 2 has a thick wall portion 215 projecting outward and axially from one side of the surrounding wall 213 and formed with a dispensing channel 23 that extends along the length of the surrounding wall 213. The thick wall portion 215 has a bottom end formed with a through hole 216 to intercommunicate fluidly the chamber 22 and the dispensing channel 23. Further, both the deformable membrane 312 and the base plate 321 have a dome shape. The deformable membrane 312 is convex and protrudes toward the base plate 321, whereas the base plate 321 is convex and protrudes toward the deformable membrane 312. The press rod 323 extends from a lowest end of the base plate 321 to a topmost end of the deformable membrane 312. The dispensing mechanism 5 includes a dispensing seat 52 mounted on a top end of the thick wall portion 215 and having an outlet tube 525, and a valve rod 54 disposed movably within the outlet tube 525. By changing the structure of the receptacle 2 and the structure of the dispensing mechanism 5 and the assembly position, a simple structure can be similarly achieved and easy assembly can be enhanced.

Figure 8:
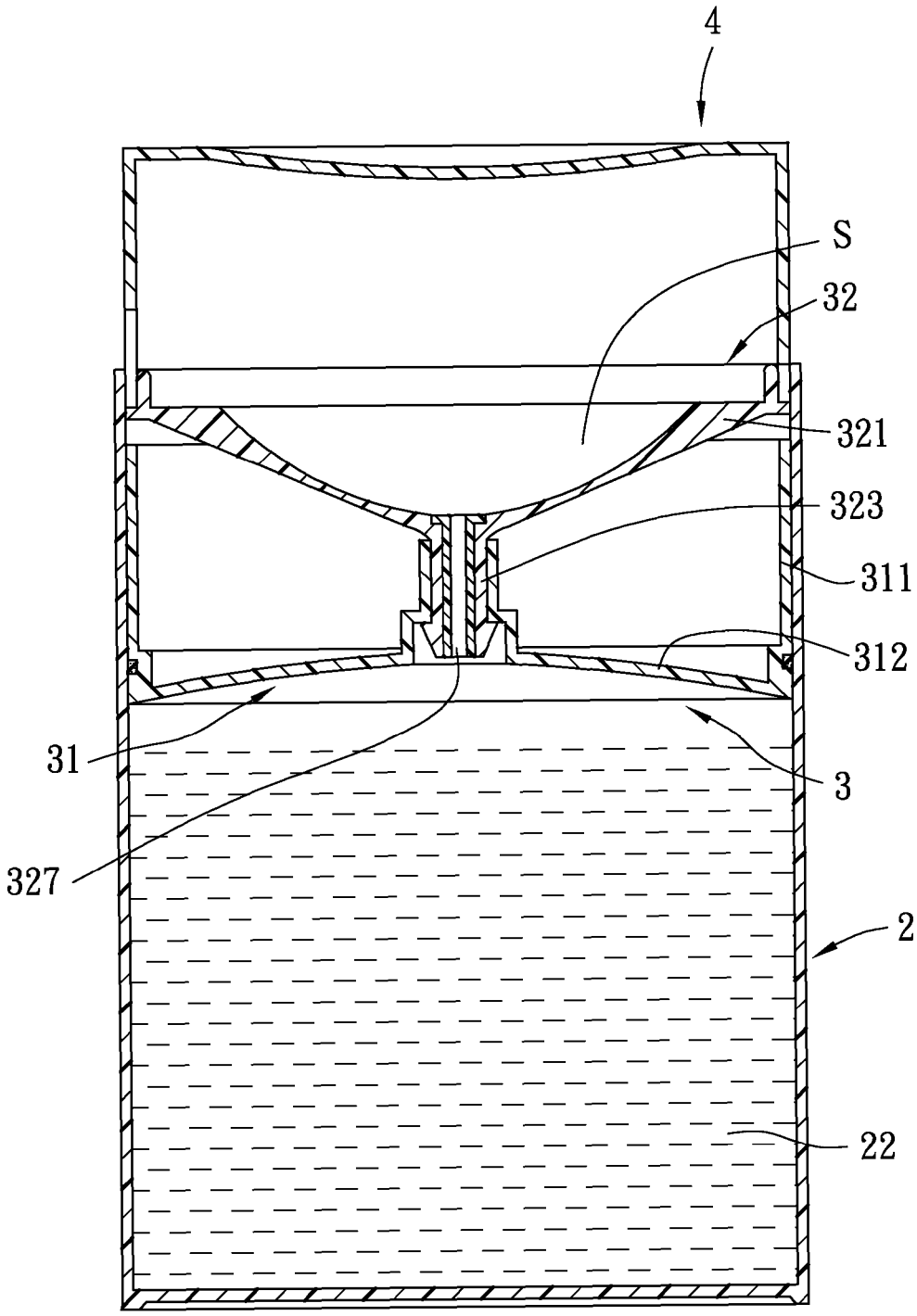
FIG. 8 is a sectional view of a liquid dispensing apparatus according to the third preferred embodiment of the present invention.

Referring to FIG. 8, a liquid dispensing apparatus according to the third preferred embodiment of the present invention is shown to be similar to the second preferred embodiment. However, in this embodiment, the press rod 323 has a liquid passage 327 that extends through top and bottom ends of the press rod 323 and that connects fluidly the chamber 22 to a space (S) above the base plate 321. Through this configuration, the liquid material in the chamber 22 can be squeezed out via the liquid passage 327, and when the downward pressure on the cover 4 is released, the deformable membrane 312 returns to its original position, and produces a suction force to draw the liquid material in the liquid passage 327 back into the chamber 22.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A liquid dispensing apparatus comprising:

a receptacle defining a chamber for containing a liquid material and having a top opening; and a press mechanism including a sealing valve disposed movably in said chamber and covering said top opening, and a press seat disposed above said sealing valve to move said sealing valve in said chamber, said sealing valve having a deformable membrane facing an interior of said chamber and adapted to press the liquid material, said press seat having a base plate, and a press rod projecting downwardly from said base plate and having a lower end connected to said deformable membrane, wherein said deformable membrane deforms when pressed by said press rod, and produces a suction force when returning to an original shape;

wherein said deformable membrane has a dome shape, is convex, and protrudes upward, said lower end of said press rod being connected to a topmost part of said deformable membrane; and wherein said sealing valve further has a peripheral wall extending upward from an outer periphery of said deformable membrane and abutting against an inner wall face of said receptacle, said deformable membrane having a maximum height measured from a plane of said outer periphery of said deformable membrane that is larger than a spacing between a top end of said peripheral wall and said base plate.

2. The liquid dispensing apparatus of claim 1, further comprising a dispensing mechanism mounted to said receptacle and being movable between a dispensing position and a closed position.

3. The liquid dispensing apparatus of claim 1, further comprising a cover fitted to a looped wall extending upwardly from said base plate.

4. The liquid dispensing apparatus of claim 2, wherein said receptacle includes a bottom wall, a surrounding wall extending upwardly from said bottom wall, and an insert portion projecting upwardly from a top end of said surrounding wall, said sealing valve further having a connecting tube defining a first channel, said dispensing mechanism including a positioning seat engaging said insert portion and having a connecting hole, a dispensing seat mounted on said positioning seat and having a second channel and a liquid outlet communicating fluidly with said second channel, a valve rod disposed movably on said dispensing seat to close or open said liquid outlet, and a connecting hose interconnecting fluidly said first and second channels.

5. The liquid dispensing apparatus of claim 3, wherein said cover has a top wall, and a surrounding wall extending downward from said top wall and sleeved fittingly around said looped wall, said surrounding wall having an axially extending slot.

6. The liquid dispensing apparatus of claim 1, further comprising a cover, said cover including a surrounding wall having an axially extending slot, said dispensing mechanism including a dispensing seat mounted on said receptacle and having an outlet tube extendable through said slot.

7. The liquid dispensing apparatus of claim 1, wherein said base plate has a dome shape, said deformable membrane is convex and protrudes toward said base plate, and said base plate is convex and protrudes toward said deformable membrane, said press rod extending from a lowest end of said base plate to a topmost end of said deformable membrane.

8. The liquid dispensing apparatus of claim 1, wherein said press rod has a liquid passage that extends through top and bottom ends of said press rod and connects fluidly said chamber to a space above said base plate.

* * * * *